US009355757B2

(12) United States Patent
Debladis et al.

(10) Patent No.: US 9,355,757 B2
(45) Date of Patent: May 31, 2016

(54) ELECTRICAL CABLE FITTED WITH A THEFT DETERRENCE MEANS

(75) Inventors: Francis Debladis, Sainte Catherine les Arras (FR); David Dickson, Westmeath (IE)

(73) Assignee: NEXANS, Paris (FR)

( * ) Notice: Subject to any disclaimer, the term of this patent is extended or adjusted under 35 U.S.C. 154(b) by 216 days.

(21) Appl. No.: 14/122,112

(22) PCT Filed: Apr. 26, 2012

(86) PCT No.: PCT/FR2012/050929

§ 371 (c)(1),
(2), (4) Date: Feb. 19, 2014

(87) PCT Pub. No.: WO2012/175830

PCT Pub. Date: Dec. 27, 2012

(65) Prior Publication Data

US 2014/0190740 A1 Jul. 10, 2014

(30) Foreign Application Priority Data

Jun. 20, 2011 (FR) ..... 11 55367

(51) Int. Cl.
*H01B 9/00* (2006.01)
*H01B 13/34* (2006.01)
*H01B 7/36* (2006.01)

(52) U.S. Cl.
CPC ..... *H01B 9/006* (2013.01); *H01B 7/36* (2013.01); *H01B 13/34* (2013.01); *Y10T 29/49117* (2015.01)

(58) Field of Classification Search
CPC ..... H01B 9/006; H01B 13/34; H01B 7/36
USPC ..... 174/70 R; 29/825
See application file for complete search history.

(56) References Cited

U.S. PATENT DOCUMENTS

| | | | | |
|---|---|---|---|---|
| 1,607,432 | A * | 11/1926 | Bryce | 174/112 |
| 2005/0123254 | A1* | 6/2005 | Oh et al. | 385/101 |
| 2010/0264206 | A1* | 10/2010 | Holcombe et al. | 235/375 |
| 2010/0278494 | A1* | 11/2010 | Fortsch et al. | 385/111 |

FOREIGN PATENT DOCUMENTS

| | | | |
|---|---|---|---|
| CN | 101131888 | | 2/2008 |
| DE | 382092 | | 9/1923 |
| DE | 409794 | | 2/1925 |
| DE | 1939506 | * | 2/1971 |
| DE | 202007009370 | | 10/2007 |
| GB | 290770 | | 5/1928 |
| GB | 499776 | * | 1/1939 |
| WO | 2011024144 | | 3/2011 |
| WO | WO 2011024144 A1 | * | 3/2011 |

OTHER PUBLICATIONS

Search Report Dated 2012.

* cited by examiner

*Primary Examiner* — Timothy Thompson
*Assistant Examiner* — Charles Pizzuto
(74) *Attorney, Agent, or Firm* — Sofer & Haroun, LLP

(57) ABSTRACT

The invention relates to an electrical cable (1, 10) comprising at least two conducting strands (2, 3) and theft deterrence means in the form of a marking (8). The main characteristic of an electrical cable (1, 10) according to the invention is that the marking consists of a series of relief prints (8) akin to a bar code.

13 Claims, 1 Drawing Sheet

ELECTRICAL CABLE FITTED WITH A THEFT DETERRENCE MEANS

RELATED APPLICATIONS

This application is a National Phase Application of PCT/FR2012/050929, filed on Apr. 26, 2012, which in turn claims the benefit of priority from French Patent Application No. 11 55367 filed on Jun. 20, 2011, the entirety of which are incorporated herein by reference,

BACKGROUND

1. Field of the Invention

The invention relates to an electrical cable fitted with a theft deterrence means. The conductive part of electrical cables, which is formed by an arrangement of a plurality of metal strands, for example possibly made of copper, is particularly sought by thieves, because it can be resold very quickly due to its high price. The object of the invention is to propose electrical cables not fitted with an active theft deterrence means which could physically prevent a thief from stealing said cables on the spot, but to propose a deterrence means which enables stolen cables to be identified and which therefore allows a buyer to identify a fraudulent origin of said cables.

2. Description of Related Art

Cables fitted with theft deterrence means exist and are already the subject of patents. For example, patent US2010/0264206 can be cited, which relates to cables of which the surface of the copper strands has been marked by laser engraving. In this way, said cables are directly marked by means of relief markings, which are left on their surface and may represent an alphanumerical code or a series of numbers or a series of letters. This technique remains less effective with respect to malicious attacks, such as intentional burning by the thieves, since the residues will deposit on the shallower parts of the marking and will make this marking illegible. Moreover, the prints made within the scope of this marking process are rather complex insofar as they each represent a number, a letter or any other cabalistic sign.

Other marking techniques have already been used, such as the depositing of an ink or a marking material on the surface of the cable or an insulating sheath, however the marks thus produced are not resistant to a burning of the cables and are erased, without leaving any trace, thus making identification of the cable impossible.

OBJECTS AND SUMMARY

The electrical cables according to the invention have theft deterrence means based on an unalterable marking able to resist any type of attack, such as burning, said marking having the special feature of being akin to a relief barcode. The relief prints forming this marking thus have a simple and almost repetitive geometry and are therefore quickly produced by means of a widely tried and tested, and therefore well controlled, set of tools. In fact, a relief barcode may be formed, for example, by a series of lines more or less produced in relief, or by a series of larger or smaller perforations, and therefore does not require each print forming it to have a complicated motif of the number or letter type.

The invention relates to an electrical cable comprising at least two conducting strands and theft deterrence means in the form of a marking. The main feature of a cable according to the invention is that the marking consists of a series of relief prints akin to a barcode. The fact that the marking is akin to a barcode means that each print left does not necessarily have to represent a distinctive and/or figurative sign in itself, but has to be included with the other prints so that these prints as a whole constitute a distinctive signature of the cable. They may therefore have only a simple and easily reproducible configuration, such as a line or a circle, it being possible to produce said prints quickly in succession by means of a simple and widely tried and tested technique. Moreover, since the marking can be formed by means of mechanical tools for example, the prints left may have a significant depth or height, accentuating their unalterable character and making them difficult to erase. A relief print may consist of a depression, a hollowed-out portion, or a hole. However, it may also be formed by a projecting protuberance. The marking can be formed on at least one metal strand of the cable or on any other existing or added part of said cable. The term "cable" is general and, for example, may denote a simple assembly of conducting strands without a specific layout, as well as an arrangement of conducting strands in a structure fitted with insulating elements and conforming to a specific geometry.

The series of prints is advantageously repetitive over the entire length of the cable. The marking is thus spread out and therefore cannot be removed or erased by a potential thief by means of a simple and quick procedure.

In accordance with a first preferred embodiment of a cable according to the invention, the cable comprises a plurality of metal strands, the marking being formed on at least one of said strands. In the case of an arrangement of conducting strands having a central strand, the marking is preferably formed on the central strand so that it is less accessible to a thief wishing to erase or modify the marking. The central strand is advantageously marked by notching, the resultant marking being formed by a series of successive notches along the strand.

In accordance with a second preferred embodiment of a cable according to the invention, the marking is formed in an added piece, joined to the cable. The added piece thus serves as a support for the marking and thus prevents the strands from having to be marked directly so as to preserve their structural integrity. The term "added" when used with reference to the piece means that this piece is specially dedicated to the support of a marking and that it has no further functions within the cable.

The added piece advantageously extends over the entire length of the cable so as to avoid having unmarked zones of the cable likely to be fraudulently decoupled so as to be resold. In accordance with another preferred embodiment of a cable according to the invention, the added piece is a screen surrounding said cable at least in part. In addition to serving as a support for the marking in order to identify the cable, the piece may thus ensure a function of protection of said cable.

In accordance with a further preferred embodiment. of a cable according to the invention, the added piece is closely mixed with the strands in a disordered manner so as to prevent it from being extracted from said cable. In fact, the risk of forming a marking on an added piece is being able to easily and quickly remove said added piece so as to not be able to identify the origin of the cable. Placing this piece in the cable in no specific order so as to run in an uncontrolled manner between the conducting strands of the cable makes it inviolable.

The line preferably comprises a plurality of peripheral strands surrounding a central strand, the added piece being inserted between the central strand and at least one peripheral strand. It is in fact important for the marked piece to be "embedded" in the electrical cable so that it cannot be easily accessed from the outside so as to then be removed, cut or pulled out maliciously.

In accordance with a first preferred embodiment of an electrical cable according to the invention, the added piece is inserted between the central strand and all the peripheral strands. Each piece is thus closely mixed with the strands, thus making it even more difficult to access.

In accordance with a further preferred embodiment of an electrical cable according to the invention, the added piece completely surrounds the central strand. This is a simplified configuration, allowing the added piece to have a cylindrical geometry and to be akin to a sheath for the central strand, able to enclose said strand closely or more loosely.

The piece is preferably a thin metal strip. In fact, the added piece must not be bulky and must be able to interfere with the cable without causing any harmful modification so the electrical properties thereof. A strip, by definition, is a very thin piece and meets this requirement, of not being very bulky. Moreover, a metal piece is solid and easily resists mechanical or thermal stains. In this way, it does not degrade over time.

In accordance with a further preferred embodiment of an electrical cable according to the invention, the strip is made of copper.

The marking advantageously consists of a series of perforations formed in the added piece. The marking is a simple marking that can be easily made and well controlled. These perforations can be obtained by different techniques, such as punching or notching. These perforations have simple shapes and, for example, can be represented by a window or a circular or oval hole.

A series of perforations preferably comprises a plurality of perforations aligned in a longitudinal direction of said cable. The marking may thus be effective over a significant zone of the electrical line, making it possible to multiply the number of perforations and to make very specific the marking of the cable or of the line to which it has been added.

The perforations are preferably of different sizes and shapes. This diversity of the perforations further increases the marking combinations.

The strip is advantageously a band comprising additional notches on at least one of its edges. It is an additional marking that is easily produced.

The invention also relates to a method for manufacturing an electrical cable according to the invention, of which the main feature is that the prints are formed by means of a technique to be selected from mechanical punching, mechanical notching, laser radiation and water blasting.

The electrical cables according to the invention have the advantage of having a deterrence means in the form of a relief barcode, which can be formed easily and quickly by means of a well-controlled set of tools. The advantage of a relief barcode is that each print forming it does not have to have a specific and complex geometry, recognizable in itself, since it is the entire set of prints that will form the signature of the cable. Lastly, the techniques implemented in order to produce a marking on the cables according to the invention have the advantage of being able to produce reliefs of high amplitude, making said marking legible under all circumstances.

BRIEF DESCRIPTION OF THE DRAWINGS

A detailed description of two preferred embodiments of an electrical cable according to the invention will be provided hereinafter, with reference to FIGS. 1 to 3.

DETAILED DESCRIPTION

Figure 1:
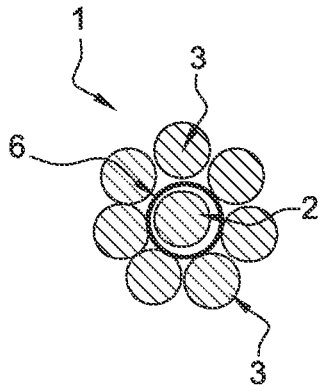
FIG. 1 is a cross-sectional view of a first embodiment of an electrical cable according to the invention.
Figure 2:
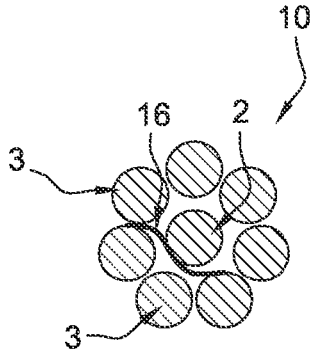
FIG. 2 is a cross-sectional view of a second embodiment of an electrical cable according to the invention.

With reference to FIGS. 1 and 2, an electrical cable 1, 10 according to the invention comprises a central conducting strand 2, surrounded by seven peripheral conducting strands 3, spaced regularly around said central strand 2, each conducting strand 2, 3 being made of copper. Each electrical cable 1, 10 comprises a theft deterrence means in the form of an added piece 6, 16, which is marked and interwoven with the conducting strands 2, 3. This added. piece 6, 16 extends over the entire length of the cable 1, 10 and therefore remains closely linked to said strands 2, 3.

Figure 3:
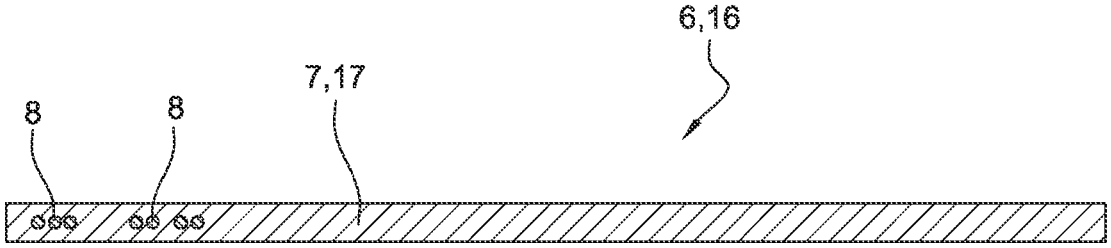
FIG. 3 is a simplified longitudinal view of a marked piece interwoven in an electrical cable according to the invention.

With reference to FIG. 3, the added piece 6 is formed by a thin strip 7, 17 made of copper, which can be easily inserted between a plurality of conducting strands 2, 3 of the electrical cable 1, 10. This strip 7, 17 has the special feature of being marked by means of a series of perforations 8, which may either all be identical or may be of different shapes and sizes. These perforations 8 are preferably aligned with one another on the strip 7, 17 along a longitudinal axis of said strip 7, 17, and therefore along a longitudinal axis of the cable 1, 10 into which the strip is incorporated. The distinctive marking of the cable 1, 10 is formed by means of a series of perforations 8, said series being repeated identically along the length of said cable 1, 10 at regular intervals. A series of perforations 8 in the strip 7, 17 thus forms a signature, making it possible to identify the origin of the electrical cable 1, 10. Each marking corresponds to a specific series of perforations 8 and is thus representative of a single cable 2, 3. A potential thief having stolen. an electrical cable 1, 10 according to the invention will therefore have difficulty in selling it, since a potential buyer will know the origin of this cable 2, 3 by means of this marking and will thus be aware of the illicit nature of the resale. A series of perforations 8 formed in the strip 7, 17 may thus be akin to a barcode.

With reference to FIG. 1, in accordance with a first preferred embodiment of an electrical cable 1 according to the invention, she strip 7 completely surrounds the central strand 2. It may thus be akin to a metal sheath for the central strand 2, either by closely enclosing said central strand 2 and remaining in contact therewith, or by being held at a distance therefrom and minimizing the contact zones therewith.

With reference to FIG. 2, in accordance with a second preferred embodiment of an electrical cable 10 according to the invention, the strip 17 can be interwoven randomly between the conducting strands 2, 3 forming the electrical cable 1, 10 so as to remain "embedded" in said cable 10 and therefore inaccessible to an ill-intentioned individual wishing to remove or pull out this strip 17 from the cable 10.

For the two preferred embodiments of an electrical cable 1, 10 according to the invention and described above, it is important to note that the strip 7, 17 must remain closely "mixed" with the strands 2, 3 of the electrical cable 1, 10 so as to remain inextricable and to dissuade a potential thief from removing it.

The electrical cables 1, 10 according to the invention thus have an inviolable signature, which makes it possible to identify the origin of said cables, said signature remaining perfectly effective with respect to intentional and malicious acts, such as burning, due to the considerable amplitude of the reliefs formed. The origin of the cables 2, 3 is constituted by a certain number of pieces of information, which may include the date of manufacture, the place of manufacture, the batch number, etc.

The invention claimed is:

1. An electrical cable comprising:

at least two conducting strands; and theft deterrence means in the form of a marking, wherein the marking is a series of relief prints akin to a barcode, said marking being formed in an added piece joined to the cable, wherein the a added piece is closely mixed the strands in a disordered manner so as to prevent said added piece from being extracted from said cable.

2. The electrical cable as claimed in claim 1, wherein the series of prints is repetitive over the entire length of the cable.

3. The electrical cable as claimed in claim 1, wherein said electrical cable has a. plurality of metal strands, the marking being formed on at least one of said strands.

4. The electrical cable as claimed in claim 1, wherein the added piece extends over the entire length of the cable.

5. The electrical cable as claimed in claim 1, wherein the added piece is a screen surrounding said cable at least part.

6. The electrical cable as claimed in claim 1, wherein said electrical cable has a plurality of peripheral strands surrounding a central strand, the added piece being inserted between the central strand and at least one peripheral strand.

7. The electrical cable as claimed in claim 6, wherein the added piece completely surrounds the central strand.

8. The cable as claimed in claim 1, wherein the piece is a thin metal strip.

9. The electrical cable as claimed in claim 8, wherein the strip is made of copper.

10. The electrical cable as claimed in claim 8, wherein the strip is a band comprising additional notches on at least one of its edges.

11. The electrical cable as claimed in claim 9, wherein a series of perforations has a plurality of perforations aligned in a longitudinal direction of the cable.

12. The electrical cable as claimed in claim 1, wherein the marking is a series of perforations formed in the added piece.

13. A method for manufacturing an electrical cable as claimed in claim 1, wherein said method implements a technique to be selected from the group consisting of mechanical punching, mechanical notching, laser radiation and water blasting. water blasting.

* * * * *